US005727719A

United States Patent [19]

Veliz et al.

[11] Patent Number: 5,727,719

[45] Date of Patent: Mar. 17, 1998

[54] BEVERAGE AND FOOD HOLDER

[75] Inventors: Jesse G. Veliz, 129 Marguarita Ave. #B, Alhambra, Calif. 91901; William Edwards, Santa Monica, Calif.

[73] Assignee: Jesse G. Veliz, Alhambra, Calif.

[21] Appl. No.: 786,537

[22] Filed: Jan. 21, 1997

Related U.S. Application Data

[63] Continuation-in-part of Ser. No. 630,632, Apr. 10, 1996, and Ser. No. 720,677, Oct. 2, 1996.

[51] Int. Cl.[6] ..... A45F 5/00

[52] U.S. Cl. ..... 224/148.4; 224/148.7; 224/615; 224/623; 224/268; 224/270; 220/503

[58] Field of Search ..... 224/148.4, 148.7, 224/199, 268, 270, 615, 623, 906, 907, 926; 108/43; 220/23.8, 503, 558, 575; 229/120.21, 904; 206/217, 562, 564, 763; 248/311.2, 313

[56] References Cited

U.S. PATENT DOCUMENTS 2,098,636 11/1937 Smith et al. ..... 224/604

5,285,940 2/1994 Goulter ..... 224/270

*Primary Examiner*—Linda J. Sholl

*Attorney, Agent, or Firm*—Don B. Finkelstein

[57] ABSTRACT

A beverage and food holder to be supported around the neck of the user and hang adjacent the chest of the user and having a sliding drawer member for receiving food, an adjustable sliding cup holder for detachably holding a variety of sizes of beverage cups and a clip means for retaining material such as a sports program.

18 Claims, 5 Drawing Sheets

BEVERAGE AND FOOD HOLDER

RELATION TO OTHER APPLICATIONS

This invention is a continuation in part of copending patent applications Ser. Nos. 08/630,632 filed Apr. 10, 1996, pending and Ser. No. 08/720,677 filed Oct. 2, 1996, pending, and the teaching and technology of each of these Applications is incorporated by reference herein.

BACKGROUND OF THE INVENTION

1. Field of the Invention

This invention relates to a food and beverage holder that is adapted to be hung around the neck of the user and rest against the chest of the user and has provisions for an expandable food holding drawer and an independently expandable beverage cup holder that is capable of detachably holding a variety if sizes of beverage cups.

2. Description of the Prior Art

There have heretofore been attempts to provide beverage supports which may be worn around the neck by means of a strap encircling the back of the neck and the beverage support hanging down from the straps and resting against the chest of the user. Such devices are shown in U.S. Pat. No. 4,993,661 and in U.S. Pat. No. 5,380,838. In the devices shown in these patents, the neck strap appears to be fixed and thus the beverage holder is not adjustable to accommodate the various heights and configurations of a variety of potential users. Further, the devices shown do not have the structure for supporting and holding various food items such as a hot dog, hamburger, bag of peanuts, or any other type of food product which the wearer of the device may desire to remove from the wearer's hand so as to leave both hands free. these devices appear to accommodate only one size of beverage container and thus are not adaptable to the wide size variations of beverage containers used at various events where the device may be used.

These devices shown in then prior an patents do not appear to have provisions for accommodating the holding of materials such as sports programs, newspapers, writing instruments or the like.

While the utility of the structure of the present invention is described for purposes of illustration as useful for spectators at sporting events such as baseball, football, hockey, basketball, horse racing and the like, it will be appreciated that the invention may be incorporated in devices useful at many other functions such as social gatherings, picnics, auctions, and the like. The venue for which the structure incorporating the present invention is not a limit upon the scope of the invention.

Thus, there has long been a need for a combined beverage and food holder which has provisions for both containing food items so as to leave the hands of the user free as well as having the capability to securely but detachably hold a wide variety of sizes of beverage containers. Further, the structure should also, preferably, have provisions for retaining a program and writing instrument such as a pencil, pen or the like.

DESCRIPTION OF THE COPENDING PATENT APPLICATIONS

In the copending patent application Ser. No. 08/630,632 and 08/720,677 there is described various embodiments of an invention for a beverage and food holder which may be worn around the neck of a spectator at a sporting event and which embodiments describe and show both fixed and movable food containing portions and beverage holding structures for accommodating various sizes of beverage containers. There is also described the provision in these embodiments for accommodating a writing instrument as well as a program. The movable food holding portions are shown to incorporate structure for both hinged and sliding food containing portions of the beverage and food holder.

SUMMARY OF THE INVENTION

Accordingly, it is an object of the present invention to provide an improved version of a beverage and food holder adapted to be worn around the neck of the user and supported against the chest of the user and which has a sliding food drawer mounted thereon and a sliding beverage container holder mounted thereon and in which the beverage container holder is movable independently of the food drawer and may accommodate a wide variety of sizes of beverage containers.

It is another object of the present invention to provide such a beverage and food holder that may be made from lightweight plastic.

It is another object of the present invention to provide a beverage and food holder which has an extended useful lie so that it may be reused at various times.

It is yet another object of the present invention to provide a beverage and food holder which may be economically fabricated and easy to use.

The above and other object of the present invention are achieved, according to a preferred embodiment thereof, by fabricating the various components of a lightweight sheet plastic such as poly propylene. There is provided a base member having a back wall adapted to rest in regions adjacent the chest of the user and the base member has side wall extending forwardly therefrom away from the user and a bottom member coupled to the bottom edge of the back member and the bottom edges of the side members to define a drawer receiving cavity therebetween. A drawer member is slidingly mounted on the base member in the drawer receiving cavity and is reciprocatingly movable from a closed position closest to the back wall to an open position spaced from the back wall. The drawer has a forward wall member, a drawer bottom member coupled to the forward wall member in regions adjacent the bottom edge thereof and extending rearwardly toward the back wall of the base member. The drawer also has a pair of spaced apart drawer side members coupled to the forward wall and to the drawer bottom wall. The height of the drawer side members is less than the height of the side wall members of the base member. The drawer bottom member is adjacent the bottom member of the base member and the drawer side wall members are in the drawer accepting cavity of the base member and adjacent the side wall members thereof. Mounting means are provided for slidingly mounting the drawer member in the cavity of the base member so that it may be manually moved in the reciprocating directions between the closed and open positions thereof.

An adjustable cup holder means is also mounted in the cavity of the base member. The cup holder means has a first pair of spaced apart cup engaging members, one of the first pair of cup engaging members coupled to one side wall of the base member in regions adjacent the top edge of the side wall of the base member and adjacent the front wall of the base member. Each of the first pair of cup engaging members has walls defining an aperture therethrough in a direction substantially parallel to the bottom wall of the base member and to the side walls of the base member. The adjustable cup holder means also has a second pair of spaced apart cup engaging members spaced forwardly towards the forward wall of the drawer member and a cross brace member for supporting the second pair of cup engaging members in an aligned relationship with said first pair of cup engaging members. A pair of rod-like members have first ends coupled to the second pair of cup engaging members and second ends extending through the apertures in the first pair of cup engaging members. The fit between the walls defining the rod accepting apertures and the rod-like members provides a predetermined frictional fit to provide a preselect resistance to movement of the rod therein. Each of the first and second pair of cup engaging members has an arcuate surface for engaging a beverage cup positioned therebetween. The bottom of the beverage cup may rest on the bottom wall of the drawer member for the drawer member in the closed position thereof or on the bottom wall of the base member for the condition of the drawer member in the open position. The second pair of cup engaging members may be moved towards and away from the first pair of cup engaging members to decrease and increase, respectively, the separation therebetween. Thus, various sizes of beverage containers may be detachably retained between the pairs of cup engaging members. In the preferred embodiment of the present invention the cup engaging members are provided with an arcuate wall for tangential engagement with the beverage container.

A clip means may be secured to the back wall of the base member on the surface thereof closest to the chest of the user so that a program or other material may be detachably secured between the clip means and the back wall of the base member. An aperture may be provided in one or more of the cup engaging members for removably holding a writing instrument such as a pen or pencil.

BRIEF DESCRIPTION OF THE DRAWING

The above and other embodiments of the present invention may be more fully understood from the following description taken together with the accompanying drawing in which similar reference characters refer to similar elements throughout and in which.

DESCRIPTION OF THE PREFERRED EMBODIMENTS

Figure 1:
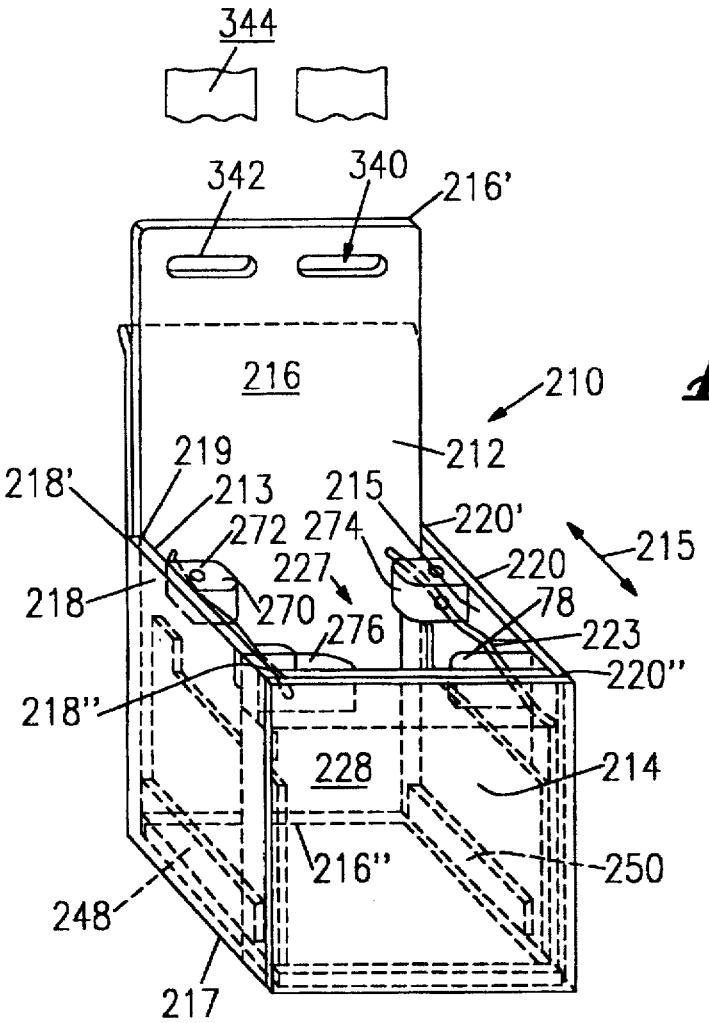
FIG. 1 is a perspective view of a preferred embodiment of a beverage and food holder according to the principles of the present invention.
Figure 2:
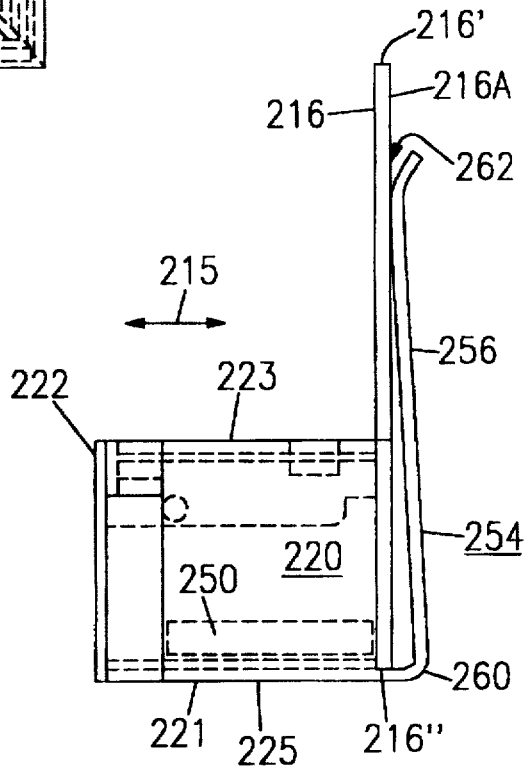
FIG. 2 is a side elevational view thereof with the drawer and cup engaging members in the closed position thereof.

Referring now to the drawing there is illustrated a preferred embodiment generally designated 10 of a beverage and food holder according to the principles of the present invention. The beverage and food holder 10 has a base member 12 upon which there is slidingly mounted a drawer member 14 for reciprocating movement in the direction of the double ended arrow 14 towards and away from a back wall 16 of the base member 12. The base member 12 has a pair of spaced apart side walls 18 and 20 coupled to the back wall 16 and extending outwardly or forwardly therefrom. The back wall 16 has a top edge 16' and a bottom edge 16" spaced from the top edge 16'. The side walls 18 and 20 have back edges 18' and 20', respectively, coupled to the back wall 16 and extending upwardly a first preselected distance from the bottom edge 16" of the back wall 16 towards the top edge 16' of the back wall 16. The side wall 18 of the base member 12 also has a top edge 19 and a bottom edge 17 and the side wall 20 has a top edge 23 and a bottom edge 21. The base member 12 also has a bottom wall 25 extending forwardly from the back wall 16. The side walls 18 and 20, bottom wall 25 and back wall 16 define a drawer receiving cavity 27 therebetween The drawer member 14 which is slidingly mounted in the drawer receiving cavity 27 thereof is illustrated most clearly in FIG. 5 and has a forward drawer wall member 28 and a pair of spaced apart drawer side wall members 30 and 32 coupled to the drawer forward wall member 28 and spaced inwardly from the side edges 28' and 28" thereof. The drawer member 14 also has a drawer bottom wall 34 coupled to the bottom edges 30' and 32' of the drawer side members 30 and 32, respectively. A pair of side trim members 36 and 38 are provided at the forward wall 28 of the drawer member 14. The drawer bottom wall 34 has extensions 40 and 42 extending laterally from the side walls 30 and 32 to define drawer rails which are a part of a mounting means generally designated 46 for mounting the drawer member 14 on the base member 12 for the reciprocating movement thereof.

The mounting means 46 is also comprised of rail guide means 48 and 50 coupled to the inner faces 15 and 13 of side wall members 20 and 18 in regions adjacent the bottom edges thereof and spaced from the bottom wall 25 of the base member 12. The rails 42 and 44 are restrained between the rail guide members 48 and 50 and the bottom wall 25 of the base member 12 to allow the reciprocating movement thereof but preventing the tipping of the drawer member 14. the bottom surface of the rail means 42 and 44 slidingly engage the bottom wall 25 of the base member 12 during the reciprocating movement.

The base member 12 and drawer member 14 are preferably manufactured from a light weight sheet plastic such as polypropylene so that the beverage and food container 10 has sufficient strength for its intended purpose but also has the capability of reuse. the plastic material allows for efficient cleaning between uses thereof.

Secured to the inner surface 16a of the back wall 16 of base member 12 is a clip means 54 which may be an extended plastic or metal flat clip section 56 extending from a bottom portion 60 secured to the back wall 16 upwardly to the top end 62 which is biased against the inner face **16*a* of back wall 16. in order to insert material such as a scorecard, newspaper, sports program or the like the clip 54 is resiliently bent away from the back wall 16 and the material inserted therebetween. Since the clip 54 is resilient, the top section 54 will spring back towards the back wall 16 for detachably clamping the material against the back wall 16**.

Figure 4:
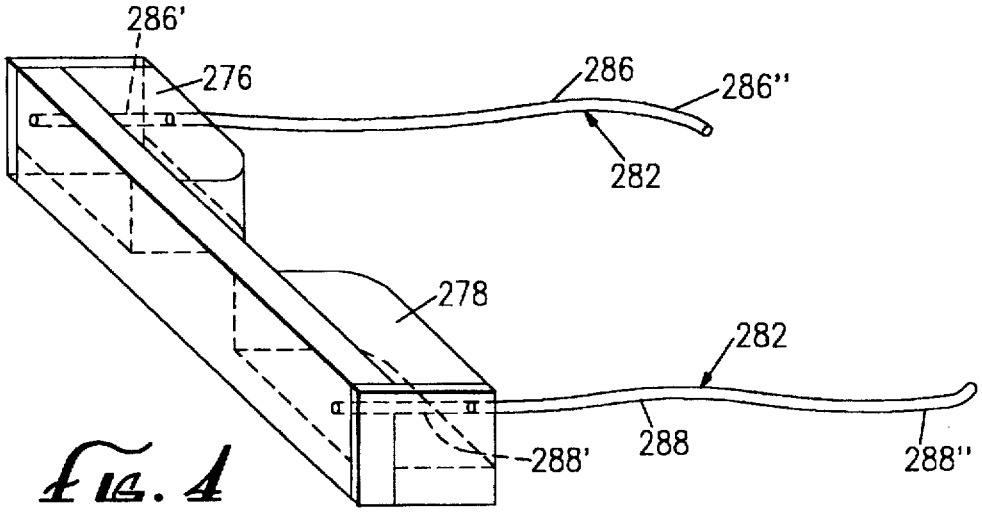
FIG. 4 is a perspective view of the movable pair of cup engaging member thereof.

An adjustable cupholder means generally designated 70 is mounted in the drawer receiving cavity 27. the adjustable cup holder 70 is comprised of a first pair of cup engaging members 72 and 74 coupled to the side walls 18 and 20 of the base member 12 in regions spaced from the bottom wall 25. A second pair of cup engaging members 76 and 78, as illustrated in FIG. 4 are movably mounted on the base member 12 for reciprocating movement towards and away from the first pair of cup engaging members 72 and 74 in the directions of the double ended arrow 15. The second pair of cup engaging members 76 and 78 are movable independently of the movement of the drawer member 14 for the condition of the drawer member 14 in the open position thereof. A cross member 80 is coupled to the second pair of cup engaging members 76 and 78 for maintaining the second pair of cup engaging members in the spaced apart relationship as illustrated in FIG. 4 as well as in alignment with the first pair of cup engaging members 72 and 74 as shown in FIG. 6.

Cup engaging mounting means generally designated 82 on FIG. 4 is comprised of a pair of rod-like members 86 and 88 having first ends 86' and 88' coupled to the second pair of cup engaging members and extending rearwardly therefrom towards the first pair of cup engaging members 72 and 74. The first pair of cup engaging members 72 and 74 have walls **72*a* and 74*a* defining rod accepting apertures 90 and 92 and the second ends 86" and 88" of rods 86 and 88 are positioned in apertures 90 and 92 for a friction fit therein to provide a preselected resistance to the movement of the second pair of cup engaging members. As illustrated in FIG. 6, the frictional fit may be provided by bending the second ends 86" and 88" of the rods 86 and 88 so that they engage the walls 72*a* and 74*a*. The remote ends 86*b* and 86*b* of rods 86 and 88 may be bent over as shown on FIG. 6 to prevent passage through the apertures 90 and 92. Alternatively, the remote ends 86*b* and 86*b* may be headed (not shown) such as by peeking, to prevent passage through the apertures 90 and 92. The remote ends 86*b* and 86*b* also engage the back wall 16 of base member 12 to limit the rearward movement of the second pair of cup engaging members as shown in FIG. 7. The cup engaging mounting means 82 also has a pair of rod guide members 94 and 96 having walls 94*a* and 96 a defining apertures 98 and 100 therethrough and the rods 86 and 88 pass through the apertures 98 and 100 for support of the second pair of cup engaging members 76 and 78. The apertures 98 and 100 may also, if desired, be sized so as to provide preselected resistance to movement of the rods 86 and 88** therethrough.

Figure 3:
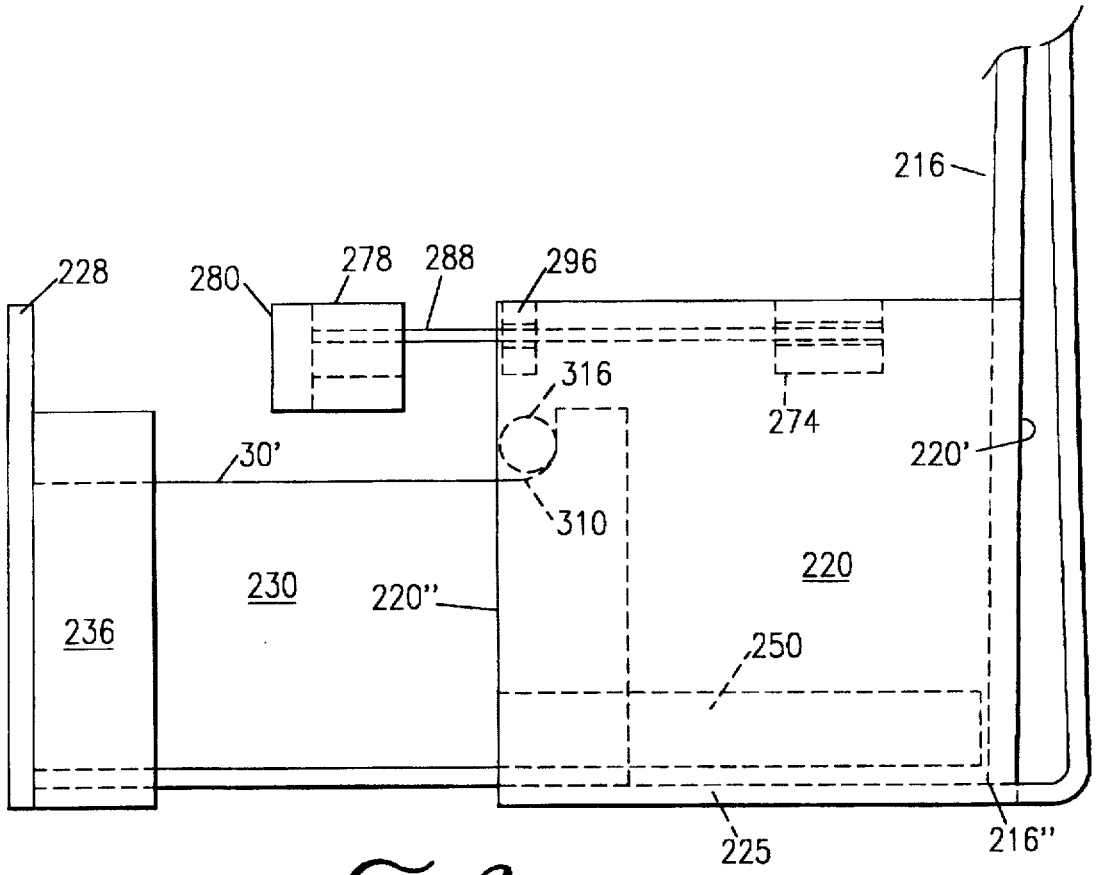
FIG. 3 is a side elevational view thereof with the drawer and cup engaging members in the open position thereof.
Figure 6:
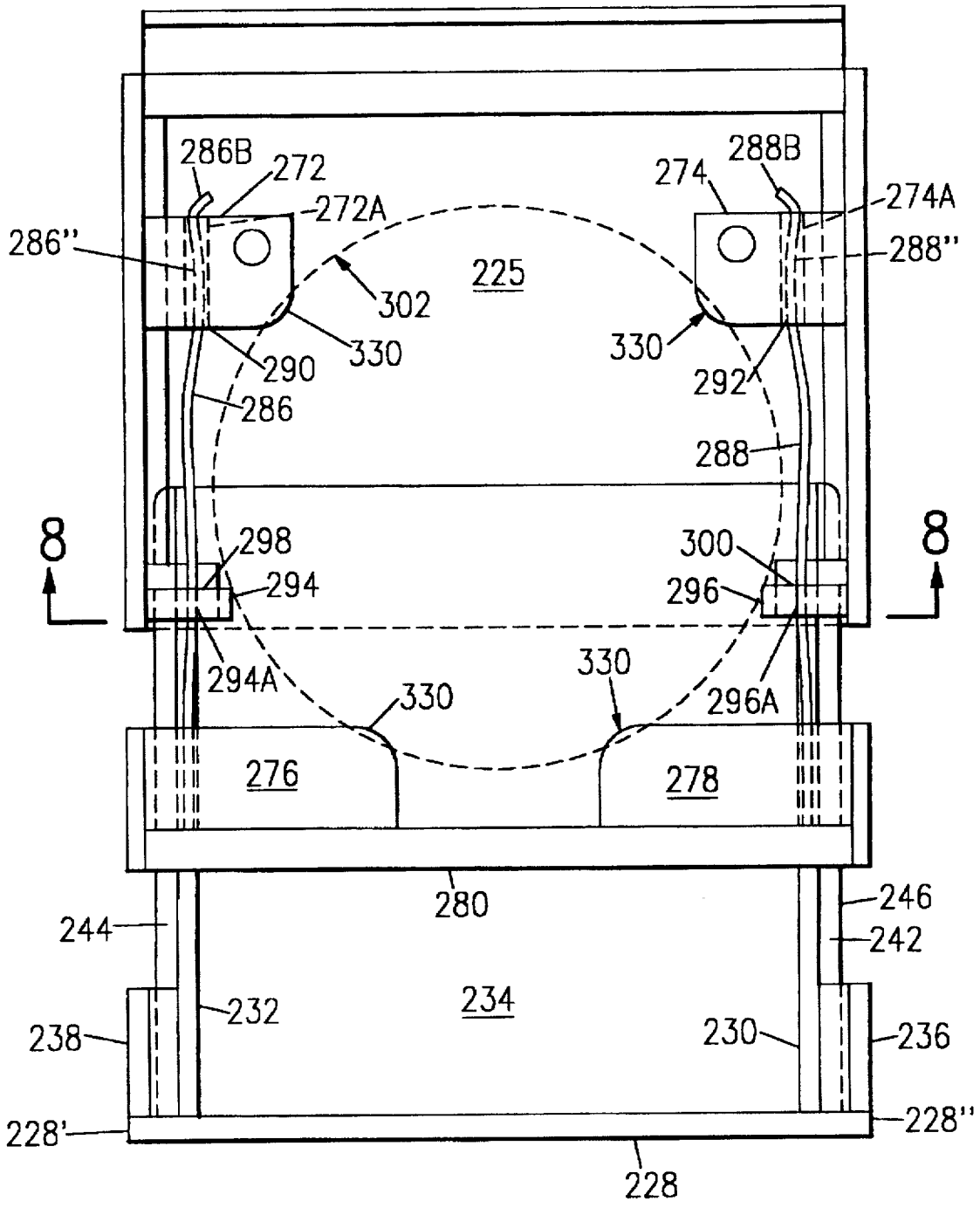
FIG. 6 is a top plan view thereof with the drawer and cup engaging members in the open position thereof.
Figure 7:
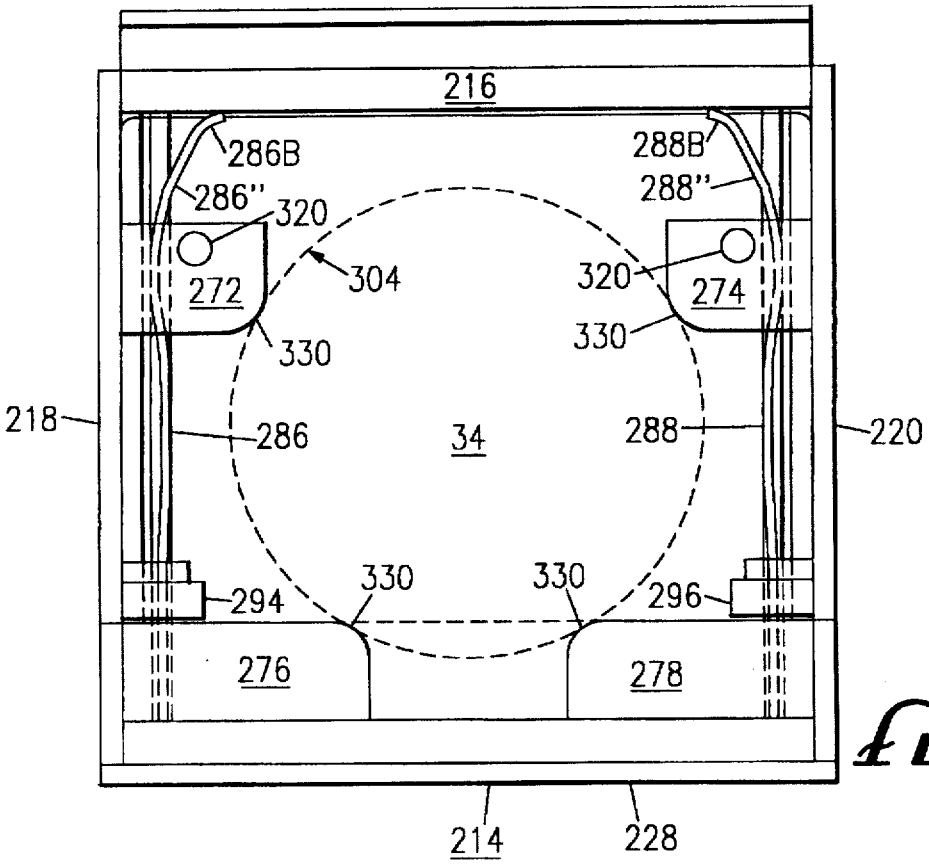
FIG. 7 is a top plan view thereof with the drawer and cup engaging members in the closed position thereof; and, FIG. 8 is a front elevational view of the base member thereof taken along the line 8—8 of FIG. 6.

With the second pair of cup engaging members 76 and 78 in the open position thereof as shown on FIGS. 3 and 6 a large diameter beverage container indicated by the dotted line 102 may be releasably restrained between the first and second pair of cup engaging members and with the second pair of cup engaging members in the closed position as indicated in FIG. 7 a small diameter beverage container may be releasably restrained as indicated by the dotted line 104. beverage containers having a diameter between the sizes indicated by the diameters 102 and 104 may be releasably restrained with the second pair of cup engaging members positioned between the open and closed positions thereof.

Figure 5:
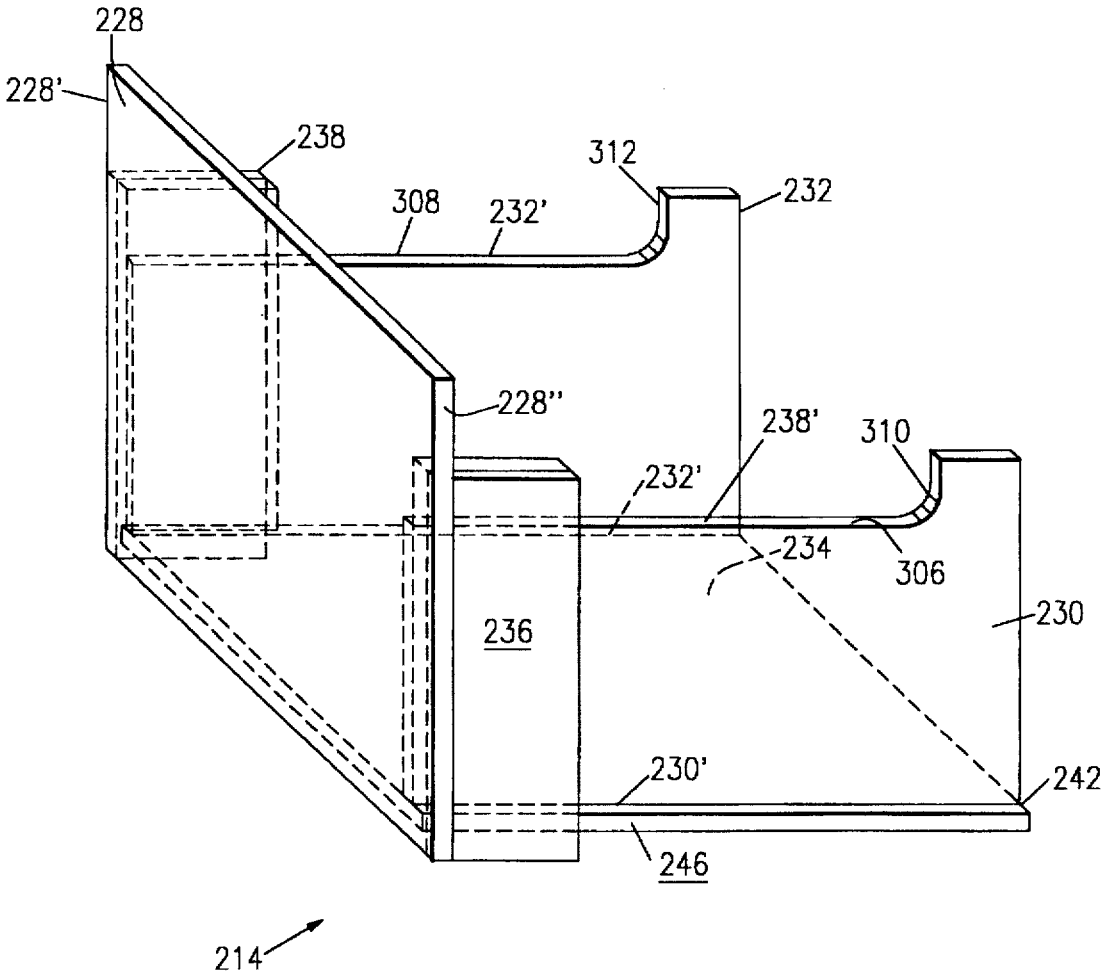
FIG. 5 is a perspective view of the drawer member thereof.

As shown on FIG. 5, the top edges 32' and 30' of drawer side wall members 32 and 30 have a cutout 106 and 108 defining a shoulder means 110 and 112. A pair of drawer stop means 114 and 116 are coupled to the side walls 18 and 20 of the base member 12 on the inner faces **18*a*' and 20*a*' thereof for engaging the shoulder means 110 and 112 to limit the forward movement of the drawer member 14**.

Figure 8:
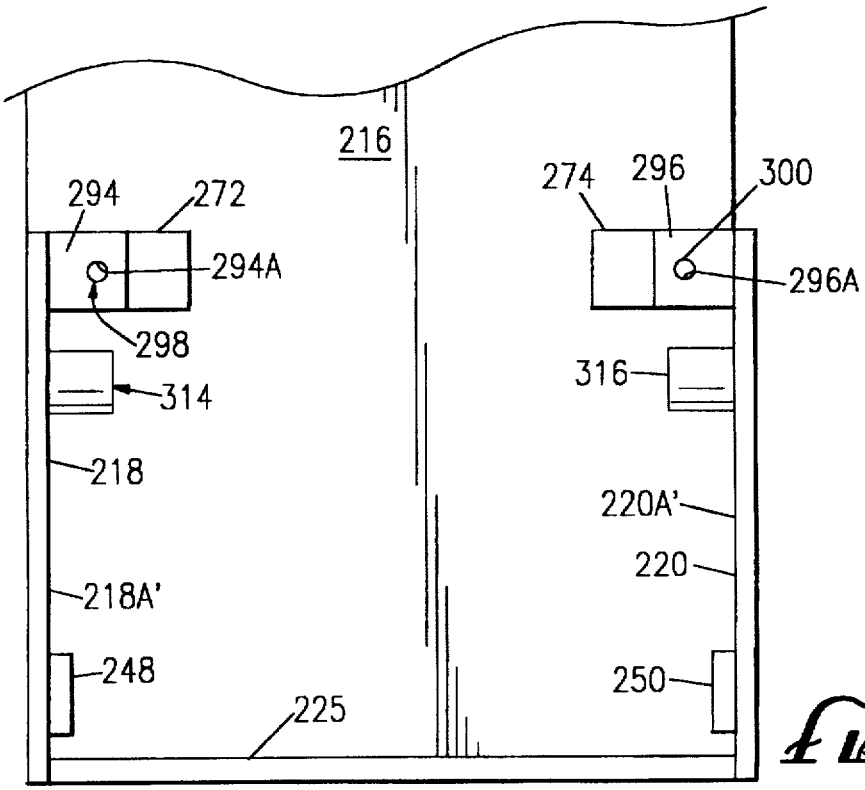

FIG. 8 shows the base member 12 with the drawer 14 and second pair of cup engaging members 76 and 78 removed for clarity. The first pair of cup engaging members 72 and 74 are spaced a greater distance from the bottom wall 25 than the drawer stop means 114 and 116. The top edges 32' and 30' of the drawer side members 32 and 34 are closer to the bottom wall 25 of the base member 12 than the adjustable cup holder means as shown on FIG. 3.

An aperture 120 may be provide in one or both of the first pair of cup engaging members 72 and 74 for receiving a writing instrument. the first and second pair of cup engaging members may be provided with arcuate wall portions as indicated at 130 on FIGS. 6 and 7 for tangential engagement with the beverage container as indicated by the dotted lines 102 and 104.

The back wall 16 of base member 12 may be provided with strap accepting apertures 140 and 142 for receiving a flexible, preferrably adjustgable strap 144 adapted to go over the neck of the user to support the beverage and food container against the chest of the user, as shown in the above mentioned copending patent applications.

This concludes the description of the present invention. Those skilled in the art may find various modifications and adaptations of the invention varying from the preferred embodiments shown and described. The appended claims are intended to cover all such modifications and adaptations falling within the scope and spirit thereof.

What is claimed is:

1. An improved food and beverage holder comprising, in combination:

a base member having a back wall adapted to rest in regions adjacent the chest of a user, said back wail having a bottom edge and a top edge space from said bottom edge, and a pair of spaced apart side walls having a back edge connected to said back wall and extending upwardly from regions adjacent said bottom edge of said back wall a first preselected distance toward said top edge of said back wall, and extending outwardly a second preselected distance from said back wall, and each of said side wails having a top edge and a bottom edge and a forward edge;

a drawer member slidingly mounted on said base member for reciprocal movement towards and away from said back wall;

mounting means for slidingly mounting said drawer member for said reciprocal movement towards and away from said back wall;

adjustable cup holder means having:

a first pair of cup engaging members coupled to said pair of side walls of said base member in regions adjacent said back wall;

a second pair of cup engaging members spaced outwardly from and substantially aligned with said first pair of cup engaging members and mounted for reciprocating movement towards and away from said first pair of cup engaging members and said back wall of said base member;

a cross brace member extending between said second pair of cup engaging members and coupled thereto for maintaining said second pair of cup engaging members in said spaced apart and aligned position; and cup engaging member mounting means for engaging said first pair and said second pair of cup engaging members for providing said reciprocating movement of said second pair of cup engaging members.

2. The arrangement defined in claim 1, and further comprising:

a pair of cup engaging member stop means for limiting the amount of said reciprocating movement of said second pair of cup engaging members.

3. The arrangement defined in claim 2 wherein said cup engaging mounting means further comprises:

walls defining a rod accepting aperture in each of said first pair of cup engaging members;

a pair of rod members each having first ends and second ends, said first end of each of said rod members coupled to one of said second pair of cup engaging members and extending rearwardly therefrom towards said back wall of said base member, said second end of each of said pair of rod members extending through said aperture in one of said first pair of cup engaging members for sliding engagement therein; and said walls of said apertures providing a predetermined frictional fit having a preselected resistance to said sliding engagement with said pair of rod members.

4. The arrangement defined in claim 3 wherein:

said base member has a bottom wall extending forwardly from said back wall and coupled thereto and coupled to each of said side walls along said bottom edge thereof, each of said side walls of said base member having an interior surface, and one said first pair of cup engaging members coupled to each of said interior surface of one of said pair of side walls in opposed relationship to each other in regions adjacent said top edges of said pair of sidewalls and spaced a third preselected distance from said back wall;

said pair of rod guide means coupled to said interior surface of said pair of side walls of said base member in opposed relationship to each other in regions adjacent aid top edge and said and said forward edge thereof and having walls defining a rod guide aperture extending therethrough and each of said rod members extending through one of said rod guide apertures.

5. The arrangement defined in claim 4 wherein:

said drawer member has a drawer base member, a forward wall member and a pair of spaced apart drawer side wall members coupled to said forward wall member and said drawer base member and extending toward said back wall of said base member;

said mounting means for said drawer member further comprises:

a rail means coupled to said drawer member and extending from said forward wall toward said back wall of said base member and having an upper surface and a lower surface;

a rail guide means coupled to said side wall members of said base member and spaced from said bottom wall of said base member for slidingly engaging said upper surface of said rail means, and said bottom surface of said rail means slidingly engaging said bottom wall of said base member.

6. The arrangement defined in claim 5 wherein:

said pair of drawer side wall members of said drawer member have a shoulder means; and further comprising:

a pair of drawer stop means coupled to said side wall members of said base member in regions adjacent said forward edge and said top edge and in shoulder engaging relationship to said shoulders of said drawer side wall members for limiting the forward movement of said drawer means away from said back wall of said base member.

7. The arrangement defined in claim 6 and further comprising:

a clip means mounted on said back wall of said base member for removable clamping action therebetween.

8. The arrangement defined in claim 7 and further comprising:

walls in said back wall of said base member defining strap accepting apertures therethrough; and strap means passing through said strap accepting apertures and adapted to pass around the neck of the user, whereby the base member is supported on the chest of the user.

9. The arrangement defined in claim 8 wherein:

said strap means is adjustable in length to allow positioning of the base member to desired positions on the chest of the user.

10. The arrangement defined in claim 9 wherein:

said clip means is intermediate said back wall of said base member and the chest of the user.

11. The arrangement defined in claim 6 wherein:

said shoulder means is on said top edge of said drawer side members.

12. The arrangement defined in claim 11 wherein:

said base member, said drawer member and said first and second pairs of cup engaging members are formed from a light weight plastic.

13. The arrangement defined in claim 12 wherein:

said plastic is polypropylene.

14. The arrangement defined in claim 2 wherein:

said cup engaging member stop means comprises a headed portion on said second end of said rod members and intermediate said first pair of cup engaging members and said back wall of said base member, and said headed member engaging said first pair of cup engaging members for limiting forward movement of said second pair of cup engaging members and engaging said back wall of said base member for limiting backward movement of said drawer member.

15. The arrangement defined in claim 14 wherein:

said headed portion comprises a bent portion of said rod members bent at an angle to the direction of travel of said drawer member to prevent passage through said rod accepting apertures.

16. The arrangement defined in claim 14 wherein:

said headed portion comprises an enlarged portion having a dimension greater than the dimension of said rod accepting apertures.

17. The arrangement defined in claim 1 wherein:

each of said first pair and said second pair of cup engaging members has an arcuate wall portion for tangential engaging of a cup positioned therebetween.

18. The arrangement defined in claim 3 wherein:

said frictional fit of said walls of said rod accepting apertures of said first pair of cup engaging members with said rod members is provided by a curved portion of said rod members for engaging said walls of said rod accepting apertures.

* * * * *